United States Patent [19]

Gibbons

[11] 4,113,633

[45] Sep. 12, 1978

[54] PENETRATING OIL COMPOSITION

[76] Inventor: Paul J. Gibbons, 831 Logan Ave., New York, N.Y. 10465

[21] Appl. No.: 750,735

[22] Filed: Dec. 15, 1976

[51] Int. Cl.[2] ..... C10M 1/48; C10M 3/42; C10M 5/24; C10M 7/46

[52] U.S. Cl. ..... 252/11; 252/32.7 E; 252/52 R

[58] Field of Search ..... 252/32.7 E, 11, 52 R

[56] References Cited

U.S. PATENT DOCUMENTS

| | | | |
|---|---|---|---|
| 2,339,096 | 1/1944 | Morgan | 252/11 |
| 3,037,932 | 6/1962 | Barker | 252/10 |
| 3,377,281 | 4/1968 | Gower | 252/32.7 E |
| 3,523,082 | 8/1970 | Vienna et al. | 252/32.7 E |
| 3,652,410 | 3/1972 | Hollinghurst et al. | 252/32.7 E |
| 3,917,537 | 11/1975 | Elsdon | 251/11 |

*Primary Examiner*—Irving Vaughn
*Attorney, Agent, or Firm*—Homer J. Bridger

[57] ABSTRACT

A penetrating oil composition is disclosed essentially consisting of a blend of lower alkyl benzenes, lower alkanols, alkyl succinic acid, tert-dibutyl-p-cresol, zinc dialkyl thiophosphate, polymethacrylate, and methyl silicone in a paraffin bright stock lube oil base.

2 Claims, No Drawings

PENETRATING OIL COMPOSITION

FIELD OF THE INVENTION

This invention relates to penetrating oils and more particularly to penetrating oils that serve to free parts which have been frozen by rust and then to loose rust and maintain lubrication between the freed parts.

BACKGROUND OF INVENTION

There are known penetrating oils which will free rust frozen parts but after freeing these parts such oils do not provide sufficient lubricity to keep the parts lubricated over extended period of time as the penetrating components volatilize. Because of such volatilization and low surface tension the penetrating components are inherently not very lubricating. On the other hand, most oils which are proper and sufficient lubricants, generally have high surface tension, high viscosity and poor spreading power and thus are poor penetrating agents.

THE INVENTION

I have discovered a blend of aromatic hydrocarbons, lower alkanols and paraffin oil hydrocarbons which, with proper additives, provides a good, rapid-acting, penetrating oil which after penetration leaves a lubricous liquid residue sufficient to serve as a general lubricant and of sufficient tenacity and film strength to protect the lubricated surfaces from rusting.

The penetrating oil of this invention is carefully balanced in proportions of components to provide penetration into the rust-frozen areas. The penetrating components of the penetrating oil composition act as the vehicle for introducing lubricants to the rusted and frozen points to free same by loosening the rust/iron bond and then leaving a film of sufficient lubricity to serve as a lubricant and rust preventive.

DETAILED DESCRIPTION

The penetrating oil of this invention comprises the following components:

| | |
|---|---|
| Mono- and di-methylbenzenes | 12 - 35% |
| Lower alkanols ($C_1$-$C_4$) | 12 - 30% |
| Antioxidants and rust-reducing agents | 1 - 4% |
| Detergents | 0.2 - 1.0% |
| VI improvers | 0 - 4% |
| Paraffin and Naphthalene bright-stock base as to | 100% |

The mono and dimethyl benzenes are chosen from toluene and the xylenes. Any of the xylenes or mixtures thereof may be used. While either toluene or xylene may be used as the methyl benzene component, a mixture of the two is preferred with a toluene/xylene ratio of about 2.5 to 1.

The alkanol component may be any lower alcohol such as methanol, ethanol or a propanol. For tax and economy reasons a blend of methanol and isopropanol is preferred in a ratio of 1 to 5 respectively. Such a ratio also blends well with the methyl benzenes.

The bright oil base is a blend of natural paraffin oils, pretreated for high-pressure, low-viscosity lubricant use, such as available commercially for transmission oils.

The antioxidants and reducing agents are those commonly used in automobile lubricants with tert-di-butyl-cresol and similar sterically hindered aromatics preferred as the prime antioxidants and augmented with zinc dialkyl thiophosphates as a combined derusting agent and antioxidant. This antioxidant mixture may also be augmented with alkyl succinic acid. Up to about 3.5 to 4% of combined antioxidants and rust looseners are sufficient but as little as 0.5% will suffice and about 2% is preferred. The zinc alkyl thiophosphate and hindered aromatics should be included for their combined loosening power.

As the composite of this invention should serve as a lubricant after the penetrating oil has freed the frozen parts, it is useful to add from 1 to 4% of the usual viscosity improvers (VI), to the penetrating oil composition of the invention so that it will properly lubricate over a wide temperature range and pressure conditions. Polymethacrylate and methyl silicone polymers in a 2 to 1 ratio in combined amounts of up to 5% are preferred VI materials. In the commonly used oil grades they not only improve the viscosity but also impart sufficient surfactant qualities to ensure coherent and adherent lubricating films.

The compositions within the ambit of this invention are set forth in the example below. When higher proportions of methyl benzenes and alkanols than those cited above are used, the compositions do not provide sufficient residual lubricity or films with adequate cohesion for lubricating and rustproofing the freed surfaces. When lower than cited proportions of methyl benzenes and alkanols are used, the compositions have poor penetration and do not serve the initial purpose of this invention, a penetrating oil.

While the amounts of antioxidants used may vary, it is preferred to use the recited range in order that by their chemical action the frozen-rust is rapidly reduced or loosened and the surfaces are freed without undue time delay or the need for excessive force (hammer impacts).

The surfactants and/or VI agents may be omitted from the composition of this invention but it is preferred that they be included to provide an improved lubrication oil to fulfil the secondary useful function of the composition of this invention.

| EXAMPLE | 1 | 2 | 3 | 4 | 5 |
|---|---|---|---|---|---|
| Toluene | 12.5 | 16.6 | 21.0 | 25.0 | 16.6 |
| Xylene | 4.0 | 5.5 | 6.5 | 8.0 | 5.5 |
| Isopropanol | 10.0 | 13.5 | 17.0 | 20.0 | 13.5 |
| Methanol | 2.1 | 2.8 | 3.5 | 4.2 | 2.8 |
| Benzyl acetate (odorant) | 1.2 | 1.6 | 2.0 | 2.4 | 1.6 |
| Tert-dibutyl-p-cresol | 0.8 | 0.7 | 0.6 | 0.4 | 0.7 |
| Alkyl succinic acid | 0.4 | 0.3 | 0.25 | 0.2 | 0.3 |
| Zinc dialkyl thiophosphate | 1.0 | 0.9 | 0.7 | 0.65 | 0.9 |
| Polymethacrylate | 1.9 | 1.6 | 1.4 | 1.1 | — |
| Methyl silicone polymer | 1.0 | 0.9 | 0.25 | 0.2 | — |
| Lube oil bright stock to 100% | | | | | |

The formulation of Example 2 has been found to provide the best combination of properties for use in automotive shops and for householder service. For plumbing, where greater penetrating activity is desired the formulation of Examples 3 and 4 is preferred. Example 5 is adequate for service where the parts will have to be cleaned and refitted after separation.

PREFERRED FORMULATION

The preferred composition for general use is thus a commercial approximation of Example 2 and has the following composition:

| | |
|---|---|
| Toluene | about 15–18% |
| Xylene | 5–6% |

-continued

| | |
|---|---|
| Isopropanol | 12–15% |
| Methanol | 2–3% |
| tert-di butyl-p-cresol | 0.5–1% |
| Alkyl succinic acid | 0.2 – 0.4% |
| Zinc di-alkyl thiophosphate | 0.7 – 1.2% |
| Polymeric VI improvers and surfactants | 1.5 – 3.5% |
| Paraffin Bright Stock lube Oil to | 100% |

All parts and percentages herein are by weight.

The cited examples and the recited materials are exemplary with the use of all art-recognized equivalents for the ancillary materials being intended.

I claim:

1. A penetrating oil composition essentially consisting of:

| | |
|---|---|
| Mono- and di-methylbenzenes | 12 – 35% |
| Lower alkanols ($C_1$ – $C_4$) | 12 – 30% |
| Polymethacrylate or methyl antioxidant selected from tert- | |

-continued

| | |
|---|---|
| dibutyl-p-oresol, alkyl succinic acid, and zinc dialkyl thiophosphate | 0.2 – 4% |
| Polymethacrylate or methyl silicone viscosity improving agents | 0 – 5% |
| paraffin bright stock lube oil to | 100% |

2. The composition according to claim 1, consisting of:

| | |
|---|---|
| Toluene | 15 – 18% |
| Xylene | 5 – 6% |
| Isopropanol | 12 – 15% |
| Methanol | 2 – 3% |
| Tert - dibutyl-p-cresol | 0.5 – 1% |
| alkyl succinic acid | 0.2 – 0.4% |
| Zinc di-alkyl thiophosphate | 0.7 – 1.2% |
| Polymethacrylate Viscosity Improver | 0 – 2% |
| Methyl Silicone Polymer Viscosity Improver | 0 – 1% |
| Paraffin Bright Stock lube oil to | 100% |

* * * * *